United States Patent [19]

Vonder et al.

[11] Patent Number: 4,795,362

[45] Date of Patent: Jan. 3, 1989

[54] CIRCUIT CONNECTOR FOR USE WITH PRINTED WIRING BOARD

[75] Inventors: David L. Vonder, Addison; William A. Reimer, Wheaton, both of Ill.

[73] Assignee: GTE Communication Systems, Inc., Northlake, Ill.

[21] Appl. No.: 163,574

[22] Filed: Mar. 3, 1988

[51] Int. Cl.[4] ..... H01R 9/09

[52] U.S. Cl. ..... 439/377; 439/629; 439/818

[58] Field of Search ..... 439/377, 629-637, 439/818

[56] References Cited

U.S. PATENT DOCUMENTS 4,131,934 12/1978 Becker et al. ..... 439/629
4,585,288 4/1986 Aikens ..... 439/629

*Primary Examiner*—Joseph H. McGlynn
*Attorney, Agent, or Firm*—Robert J. Black; Gregory G. Hendricks

[57] ABSTRACT

A mounting arrangement for printed circuit boards where electrical and mechanical connection is maintained by the characteristics of the contacts included in the connector. While support is provided for the printed wiring board, no retenion means other than the contacts themselves are employed. The combination of a rigid and a flexible contact inhibits "walking" of the board due to vibration.

12 Claims, 2 Drawing Sheets

CIRCUIT CONNECTOR FOR USE WITH PRINTED WIRING BOARD

BACKGROUND OF THE INVENTION

1. Field of the Invention

This invention relates to mounting arrangements for printed circuit cards or boards in electrical systems and more particularly to a connector which is arranged to support and retain in electrical connection a printed wiring board.

2. Description of the Related Art

Printed circuit cards or boards have been used for many years in electronic equipment. These boards allow the many electrical devices and components to be readily connected by metallic circuits formed on one or more surfaces of the board. Today, much electronic equipment includes plug-in module boards representing entire sub-systems of electronic apparatus. The use of such an arrangement is of great assistance in facilitating assembly and diagnostic evaluation of circuit problems. Such circuit boards are usually provided with a plurality of electrical contact pads or connections along one edge of the card. The entire board is then press-fitted into a specially designed edge connector, having a plurality of mating contacts. Electrical connection beteen the card edge connector and other devices in the electrical apparatus is generally made through means of separate wiring.

Although printed wiring cards are press-fitted into card edge connectors generally, these connections do not grip the edge of the inserted board with any appreciable strength. Since the printed circuit card may need to be mounted horizontally, vertically or in some other configuration, it is naturally subject to vibration in many environments. Thus, it has generally been determined that some form of support retention means must be provided in order to securably hold the printed circuit board in position in its associated card edge connector.

Prior art apparatus generally have associated with each card edge connector for supporting such printed wiring cards one or more u-shaped channels for guiding and supporting the printed circuit card. In this arrangement, the cards are placed into these channel members which act to maintain the printed circuit boards in a spaced apart, parallel or similar relationship. It has also been determined that it is not necessary to merely guide the support for the circuit cards but that each card must be securely fastened or held within this channel in order to ensure that a proper electrical connection is made and maintained between the printed circuit board card connector pads and the associated card edge connector.

The usual solution to this problem is to include some sort of releasable locking means associated with the printed circuit card so as to securely maintain the card within the guide or support. This arrangement then allows the mounted card to be readily removed when desired. Such locking means have taken many forms such as those disclosed in U.S. Pat. Nos. 3,853,379, 3,767,974 and 3,764,857. These patents all disclose a camming or lever locking means provided in the outward end of each channel guide which engages the outer corners of the associated printed circuit card. Other techniques were disclosed in such patents as U.S. Pat. Nos. 3,798,507, 3,784,954, 3,863,113, 3,741,513 and 3,715,630.

All of the above rely in some way to engage the support and the card by means of a form of locking device or by a similar technique. Most of the above techniques require a special or modified type of printed circuit card to be used with the locking and guiding means or a special latching device or devices and associated u-shaped channel guides for each printed circuit card to be mounted.

SUMMARY OF THE INVENTION

The above and other problems of prior art arrangements are overcome in the present invention by providing a connector contact scheme, wherein individual printed circuit cards are inserted into card connectors with the assistance of card guides which extend out from the face of the connector. While these card guides help to support the line cards after they are inserted, they provide nothing to overcome the effect of vibration or movement, wherein the cards frequently would "walk" out of their plugged connections.

In the present arrangement, printed circuit cards were designed as line cards for use in automated telephone systems. Since the total mass of each individual printed circuit card is relatively small, a slight amount of card retaining force could be incorporated into each individual contact. Thus, the multiplicity of contacts associated with each printed wiring card would be able to generate more than an adequate amount of retention force required to maintain the connection for each printed circuit card.

In the perceived arrangement, the two-piece connector system includes a movable contact located on the printed circuit card and a fixed contact located in the printed circuit card connector located on the front edge of the motherboard or back plane of the electronic equipment. While several different contact arrangements are shown, they all include the arrangement of a movable and a fixed contact, wherein each of the contacts have an embossed or depressed area and the blade portion of each contact is separated by a particular distance. The embossed or raised area on the movable contact has a leading angle and a trailing angle relative to the flat blade portion of the contact. It is this leading angle which controls insertion force and the trailing angle controls extraction force in the contact system.

During mating, the movable and fixed contacts are caused to flex and separate due to the embossed or raised portion on the movable contact and when the contacts are fully mated, the embossed or raised portion of the movable contact nests in the embossed or opening of the fixed contact and the blade portion of both contacts are separated by a particular distance.

In the case of a printed circuit card equipped with a large number of movable contacts, vibration may cause it to "walk" out of its plugged position. However, its nested embosses or raised portions would force the contact blades apart. Thus, the contact force would increase which in turn would then tend to maintain the two raised portions in the nested or retained position. In effect, the electrical contacts are also the mechanical means by which the printed circuit boards are kept in their plugged positions. In commercial application, the retention forces would be made large enough to prevent the printed circuit boards from "walking" but low enough to keep card extraction forces reasonable when a printed circuit board is purposely withdrawn.

Several different blade contact configurations are anticipated under the terms of the present invention, including the utilization of a stiff contract with leading and trailing wedge-type edges and an associated slot in the movable contact. Another approach would include contacts with convex and concave dimpled areas and conventional flat springs with curved sections included therein.

DESCRIPTION OF THE PREFERRED EMBODIMENT

The connector contact scheme of the present invention was designed for use in packaging a solid-state line frame for use in the GTD-5 EAX Digital Telephone System manufactured by GTE Communication Systems Incorporated. The technique of packaging line circuits into a frame in a space-saving and cost-effective manner is of prime importance since the line frames make up typically 50–60% of all the frames included in a modern telephone central office. Thus, it will be apparent that the cost of the line frame may very well impact the system cost by more than any other frame required throughout the entire telephone system.

Figure 1:
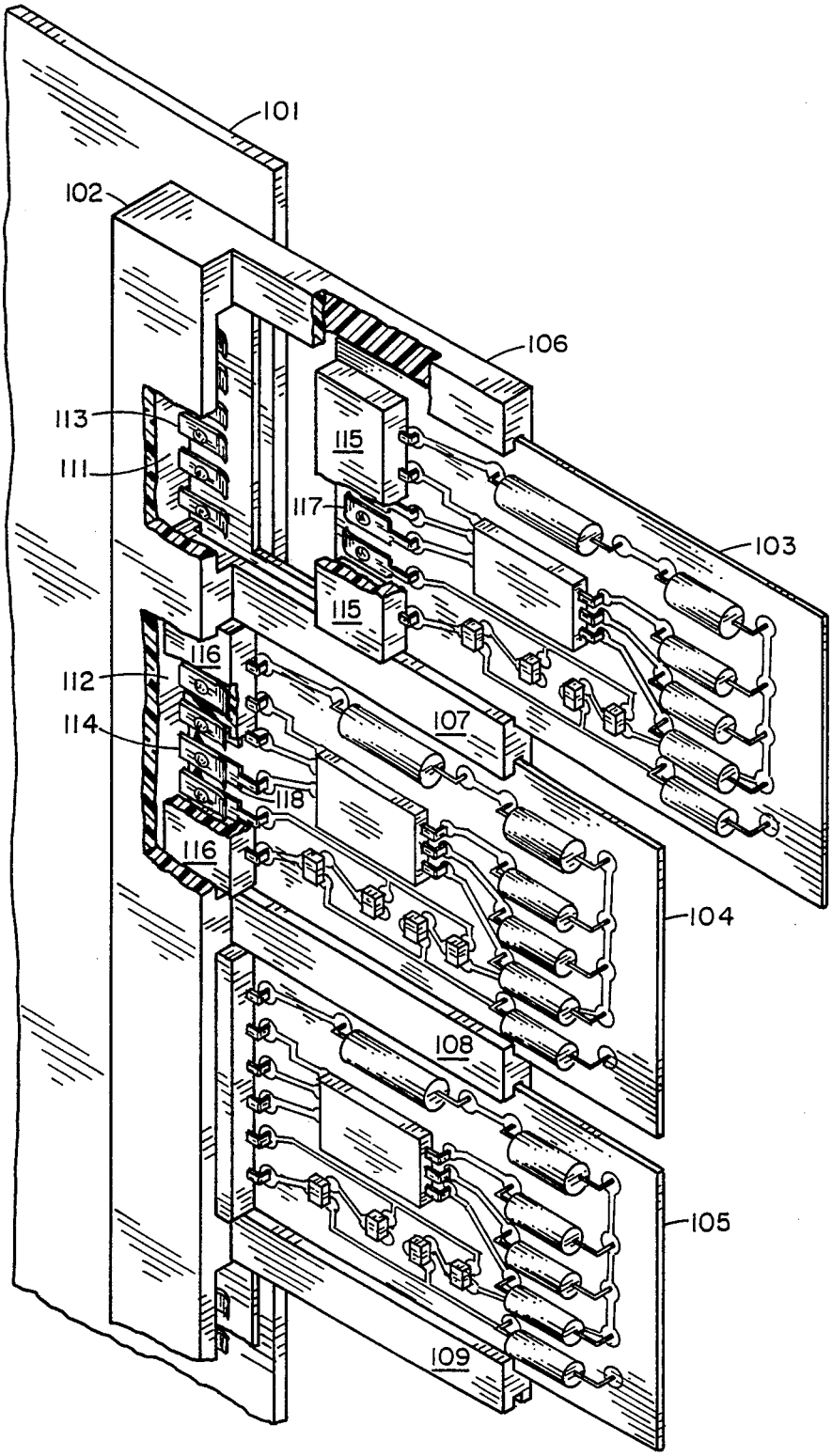
FIG. 1 is a partially cut out perspective view of a plurality of printed circuit boards and associated connectors and supports including retention type contacts in accordance with the present invention.

Referring now to FIG. 1, a typical solid-state line frame in accordance with the present invention includes a plurality of files of 24½ high motherboards 101 as shown in part in FIG. 1. In the anticipated arrangement, each file would contain 32 motherboards on 1" centerlines. Each motherboard has two columns of 12 line cards located at the front edge. As may be seen in FIG. 1, three line cards only have been shown for purposes of clarification. These are numbered 103, 104 and 105, respectively. In accordance with the present embodiment, each line card is approximately 1½" wide by 3½" long. The line cards are plugged into a two-piece dual bodied connector 102 located at the front end of motherboard 101. It is this connector 102 shown in multiple form that becomes the basis of the present invention.

As may be seen by reference to FIG. 1, the individual line cards, such as 103, 104 and 105, are inserted into the line card connector 102 with the help of card guides 106, 107, 108 and 109 which extend out from the face of connector 102. These card guides also help to support the line cards after they are inserted. The principal intent of the present invention is to provide means whereby the cards may be prevented from "walking" out in response to vibration.

Inasmuch as the total mass of each of the individual line cards 103, 104, 105, etc. are fairly small, it can be determined that if a slight amount of card retaining force could be incorporated into each individual contact included with each of the line cards, the approximately 22 contacts associated with each line card would generate more than the amount of retaining force required to maintain the plugged connection for each line card. For purposes of clarification, a substantially fewer number of contacts have been shown in the drawing, such as the contacts 111 and 112 shown in the connector portion and contacts 117 and 118 shown attached to the line cards themselves. A number of different contact arrangements have been shown and will be described in detail at this point.

Figure 2A:
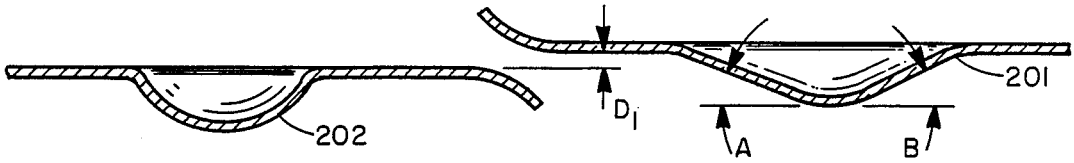
FIGS. 2A, 2B and 2C show traditional flat contacts with curved portions therein of each arranged prior to mating, during mating and with the contacts mated all in accordance with the present invention.
Figure 2B:
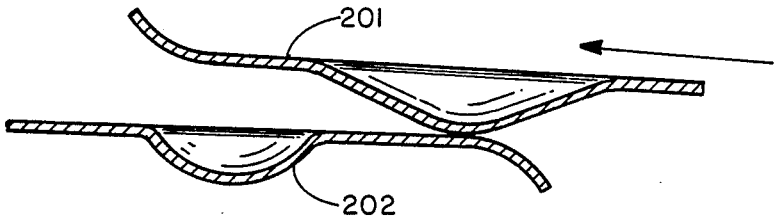
Figure 2C:
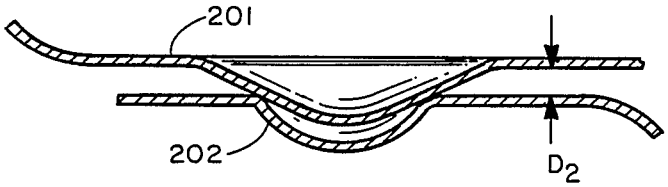

Referring first to FIGS. 2A, 2B and 2C, the molded housings, such as 102, are not shown for purposes of clarity since they do not represent any particular new technology. The contacts shown in FIGS. 2A, 2B and 2C are flat material contacts of a spring construction as conventionally used for contacts and is suggested being bent in accordance with the configuration shown. Referring again to FIG. 2A, movable contact 201 and the fixed contact 202 are shown in cross section prior to mating. Each of the contacts, as may be seen in FIG. 3, have an embossed area having a concave or convex depression in the blade portion of each contact. The flat blade portions of each contact are separated by a distance shown as $D_1$. The embossed portion of depressed concave section of the movable contact 201 has a leading angle A and a trailing angle B relative to the flat blade portion of the contact. The leading angle A controls the insertion force and the trailing angle B controls the extraction force of the contact system. As may be seen in FIG. 2B during mating, the movable and fixed contacts are caused to flex and separate due to the embossed or depressed portion on the movable contact. When the contacts are fully mated, as seen in FIG. 2C, the depressed or embossed portion of the movable contact is nested in the embossed or depressed portion of the fixed contact and the blade portion of both contacts are separated by distance $D_2$. As may be seen by reference to FIGS. 2A and 2C, the distance $D_2$ is greater than $D_1$ which means both springs are still in a deflected position relative to their free states. If a line card, which is equipped with a substantial number (such as 22 in the present embodiment) of movable contacts, starts to vibrate or "walk" out of its plugged position, the nested embosses or depressions would force the contact blades apart and distance $D_2$ would have to increase. However, the contact forces would also have to increase which in turn will then tend to maintain the two embosses or depresses in the nested position. Thus, in effect, the electrical contacts are also the mechanical means by which each individual line card is maintained in its proper plugged position. In practice, these retention forces would be made large enough to prevent the line cards from "walking", but low enough to keep card extraction forces reasonable when a line card is purposely withdrawn as may be required for maintenance or other purposes.

Figure 3:
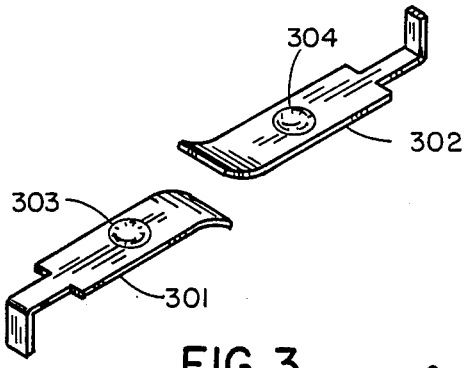
FIG. 3 shows contacts in accordance with the present invention employing convex and concave dimpled areas.

Referring now to FIG. 3, blade contacts are shown employing circular embosses or depressions as described in connection with FIGS. 2A, 2B and 2C. As in FIGS. 2A, 2B and 2C, the leading edges of the blades of each set or pair of contacts have been curved so as to prevent stubbing of the blade contacts during initial engagement. As may be seen in FIG. 3, the movable contact 301 includes a depression or dimpled area 303, while the stiff or fixed contact 302 includes a similar depression 304.

Figure 4:
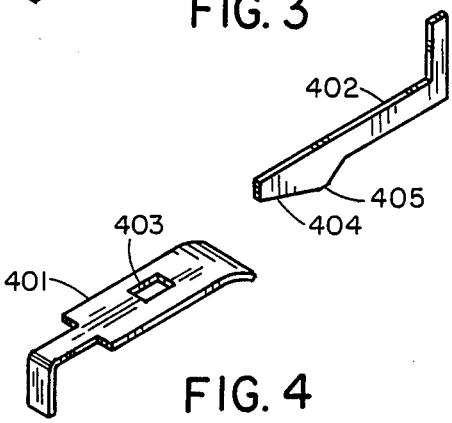
FIG. 4 shows contacts in accordance with the present invention employing a stiff contact having a ramp-like configuration and an associated spring contact including a slot for receiving the joinder of the two ramp portions of the stiff contact.

Referring now to FIG. 4, similar principles are discussed. The combination shown in FIG. 4 consists of a movable spring contact 401 including a slot 403 therein and a rigid or stiff contact 402 having a forward projecting ramp 404 and a rearward facing ramp 405. The combination of the contacts of FIG. 4, like those in FIG. 3, is similar and follows the same general form of operation during mating as described in connection with the discussion of FIGS. 2A, 2B and 2C. During actual engagement, however, of the contacts of FIG. 4, the ramp portion consisting of the forward and rearward facing ramps 404 and 405 glides across the spring contact 401 and engages slot 403, the juncture portion of contact 402 being where ramps 404 and 405 meet.

Referring again to FIG. 1, it can be seen how card 103 is yet to be inserted when pushed in a forward direction. While being maintained in position by guides 106 and 107, the contacts 117, which are retained in the part of the connector known as 115, will advance forward to engage the resilient or flexible contacts 113 which will engage and retain both electrical and mechanical contact.

Also, as may be seen in FIG. 1, card 104 has been inserted so that the rigid contacts, such as 118, are now engaging the contacts such as 114. It can also be seen here that contacts, such as 113 and 114, are a portion of the connector 102 affixed to the motherboard 101 while the contacts, such as 117 and 118, are included in that portion of the connector known as 116.

It will be obvious to those skilled in the art that numerous modifications of the present invention may be made without departing from the spirit of the invention which shall be limited only by the scope of the claims appended hereto.

What is claimed is:

1. A connector arranged to support and retain in electrical connection therewith a printed wiring board, said board including first and second side surfaces, said connector comprising:

a connector receptacle body;

at least one receptacle recess formed in said connector receptacle body, said cavity receiving therein via a first mating direction a front edge of said printed wiring board;

at least a lower guide connected to said connector receptacle body, said lower guide engaging a lower edge of said printed wiring board to support said printed wiring board;

at least one connector receptacle contact positioned within said connector cavity;

at least one connector plug contact attached to said printed wiring board adjacent to said front edge, said plug contact adapted to mate with said receptacle contact;

an engagement retaining means formed on said receptacle contact; and an engagement retaining means formed on said plug contact, said plug contact retaining means engaging said receptacle contact retaining means in response to the mating of said contacts to retain said plug and receptacle contacts in mated engagement.

2. A connector as claimed in claim 1, wherein:

said lower guide is formed integral with said connector receptacle body.

3. A connector as claimed in claim 1, wherein:

said plug engagement retaining means includes a projection projecting from said plug contact away from said board first side surface and in a direction toward said receptacle contact.

4. A connector as claimed in claim 3, wherein:

said receptacle engagement retaining means includes a depression extending in a direction away from said plug contact.

5. A connector as claimed in claim 3, wherein:

said projection includes a spherical projection.

6. A connector as claimed in claim 4, wherein:

said depression includes a spherical depression.

7. A connector as claimed in claim 3, wherein:

said projection includes a blade residing in a plane perpendicular to said printed wiring board surface and parallel to said mating direction;

said blade including a far end adjacent said board front edge and an opposite near end distant from said board front edge, said blade additionally including a mating surface extending from said blade far end adjacent said printed wiring board surface at a first acute angle to said board surface, said blade further including a disengagement surface extending from a point on said blade near said board surface at a second acute angle to said board surface.

8. A connector as claimed in claim 7, wherein:

said receptacle contact is of planar construction and said receptacle contact retaining means includes an aperture in said receptacle, said aperture including at least a rear edge engaged with said blade mating surface and a front edge engaged with said blade disengagement surface, said aperture rear and front edges establishing electrical contact between said connector and said printed wiring board.

9. A connector as claimed in claim 1, wherein:

said connector receptacle body includes a first wall formed parallel to and engaging said printed wiring board second side surface, said first wall defining a wall recess, said receptacle contact positioned within said recess spaced apart a predetermined distance from said first wall.

10. A connector as claimed in claim 9, wherein:

said connector receptacle body includes a second wall formed parallel to said first wall and spaced apart a predetermined distance therefrom, said connector receptacle contact positioned between said first and said second receptacle walls and proximate to said second receptacle wall.

11. A connector as claimed in claim 10 wherein:

said connector includes a connector plug wall formed parallel and attached to said printed wiring board, said connector plug contact positioned between said connector plug wall and said printed wiring board and said connector plug wall positioned between said connector receptacle second wall and said connector receptacle contact and abutting said connector receptacle second wall.

12. A connector as claimed in claim 1, wherein:

said printed wiring board and said connector plug contact are positioned between said connector receptacle contact and said connector receptacle body first wall.

* * * * *